US006138910A

United States Patent [19]

Madruga

[11] Patent Number: 6,138,910

[45] Date of Patent: Oct. 31, 2000

[54] DELIVERY VAULT

[75] Inventor: Tony O. Madruga, Highlands Ranch, Colo.

[73] Assignee: dVault, Inc., Highland Ranch, Colo.

[21] Appl. No.: 09/221,204

[22] Filed: Dec. 23, 1998

Related U.S. Application Data

[60] Provisional application No. 60/068,698, Dec. 23, 1997.

[51] Int. Cl.[7] ..... G06K 15/00

[52] U.S. Cl. ..... 235/383; 235/462.13

[58] Field of Search ..... 235/462.13, 383; 232/47, 19, 20, 27, 28, 34, 35, 36, 37

[56] References Cited

U.S. PATENT DOCUMENTS 3,976,345 8/1976 Walters ..... 232/31

5,247,282 9/1993 Marshall .

5,695,113 12/1997 Rau et al. ..... 232/34

5,979,750 11/1999 Kindell ..... 232/19

*Primary Examiner*—Karl D. Frech

*Attorney, Agent, or Firm*—Blakely, Sokoloff, Taylor & Zafman LLP

[57] ABSTRACT

A specialized receptacle accommodates secure delivery of mail and small packages. The receptacle has a loading door hinged on the receptacle structure. The loading door has a main section and a secondary section that telescopes out of the main section as the loading door is opened. The telescoping section supports packages as they are delivered and prevents unauthorized access to the storage compartment of the receptacle.

3 Claims, 3 Drawing Sheets

DELIVERY VAULT

RELATED APPLICATION

This application claims the benefit of co-pending provisional application Ser. No. 60/068,698 filed Dec. 23, 1997.

BACKGROUND OF THE INVENTION

1. Field of the Invention

This invention relates generally to the field of storage containers. More particularly, the invention is a receptacle for the secure delivery and temporary storage of small parcels and the like.

2. Prior Art

In recent years there has been explosive growth in shipments of small parcels. Competition among numerous delivery services has kept the cost of delivery reasonable. At the same time, mail order businesses have seen tremendous growth. Moreover, Internet-based retail businesses have proliferated, adding further to the volume of small parcel deliveries.

While more and more small parcels are being delivered, very little has been done to facilitate final delivery, particularly at residential locations. Frequently, deliveries are attempted at times when the residents are not at home. Depending upon the policies of the delivery service, delivery must then be attempted on a subsequent day or the package may be simply left on the recipient's door step. Each of these alternatives has disadvantages for the recipient. In the first case, delivery of the package is delayed, while in the second case, the package is subject to damage or theft. Therefore, there is a perceived need for a device to provide secure storage of delivered packages, particularly at residences.

SUMMARY OF THE INVENTION

The present invention provides a secure receptacle for receiving deliveries of mail and small packages. In one embodiment, the invention comprises an enclosed receptacle structure; a loading door hingedly coupled to the receptacle structure, the loading door comprising a main section with an upper portion and a lower portion and a secondary section slidably coupled to the lower portion of the main section; and a linkage member having a first end pivotally coupled to the secondary section and a second end pivotally coupled to the receptacle structure such that the secondary section extends and retracts from the lower portion of the main section during operation of the loading door.

DETAILED DESCRIPTION OF TH INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
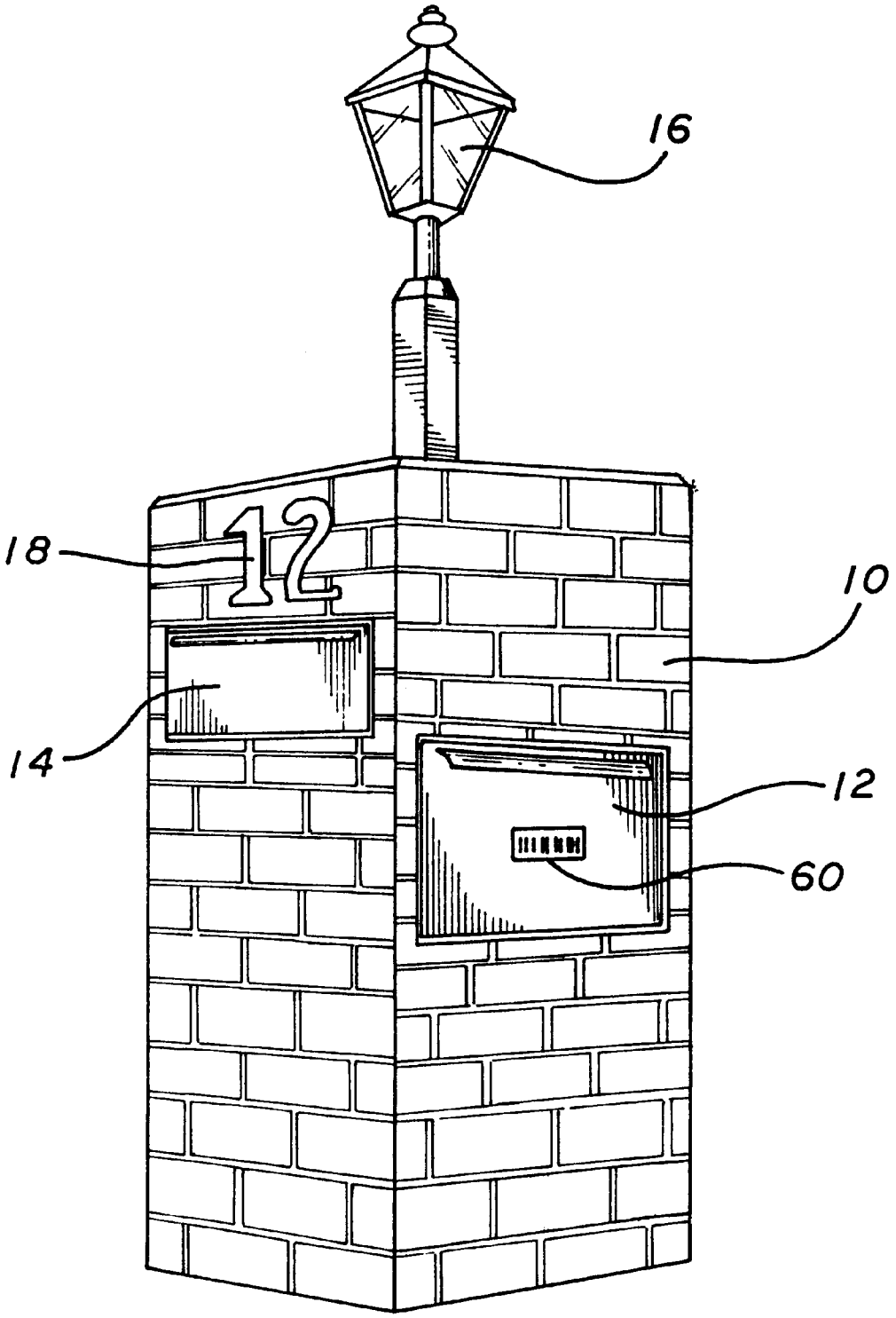
FIG. 1 is a perspective view of a delivery receptacle constructed in accordance with the present invention.

An exemplary embodiment of the present invention is illustrated in FIG. 1. Delivery receptacle 10 is in the form of a free-standing rectangular box-like structure. A loading door 12 is provided for receiving small packages and the like. Loading door 12 communicates with a first interior compartment as described below. A second loading door 14 may be provided for receiving normal mail deliveries, including letters, magazines and the like. If provided, loading door 14 communicates with a second compartment that is separate from the first compartment. Loading doors 12 and 14 may be located on different sides of receptacle 10 as shown or on the same side. If desired, either or both of doors 12 and 14 may have slots for deposit of flat articles.

For residential applications, receptacle 10 may have its exterior surfaces covered with a decorative material, such as brick, marble, ceramic, etc. Receptacle 10 may include a lamp 16, which, together with a decorative covering, helps blend receptacle 10 into a residential setting. Receptacle 10 preferably includes indicia 18 to display the street address of the receptacle for the convenience of individuals making deliveries thereto.

Figure 2:
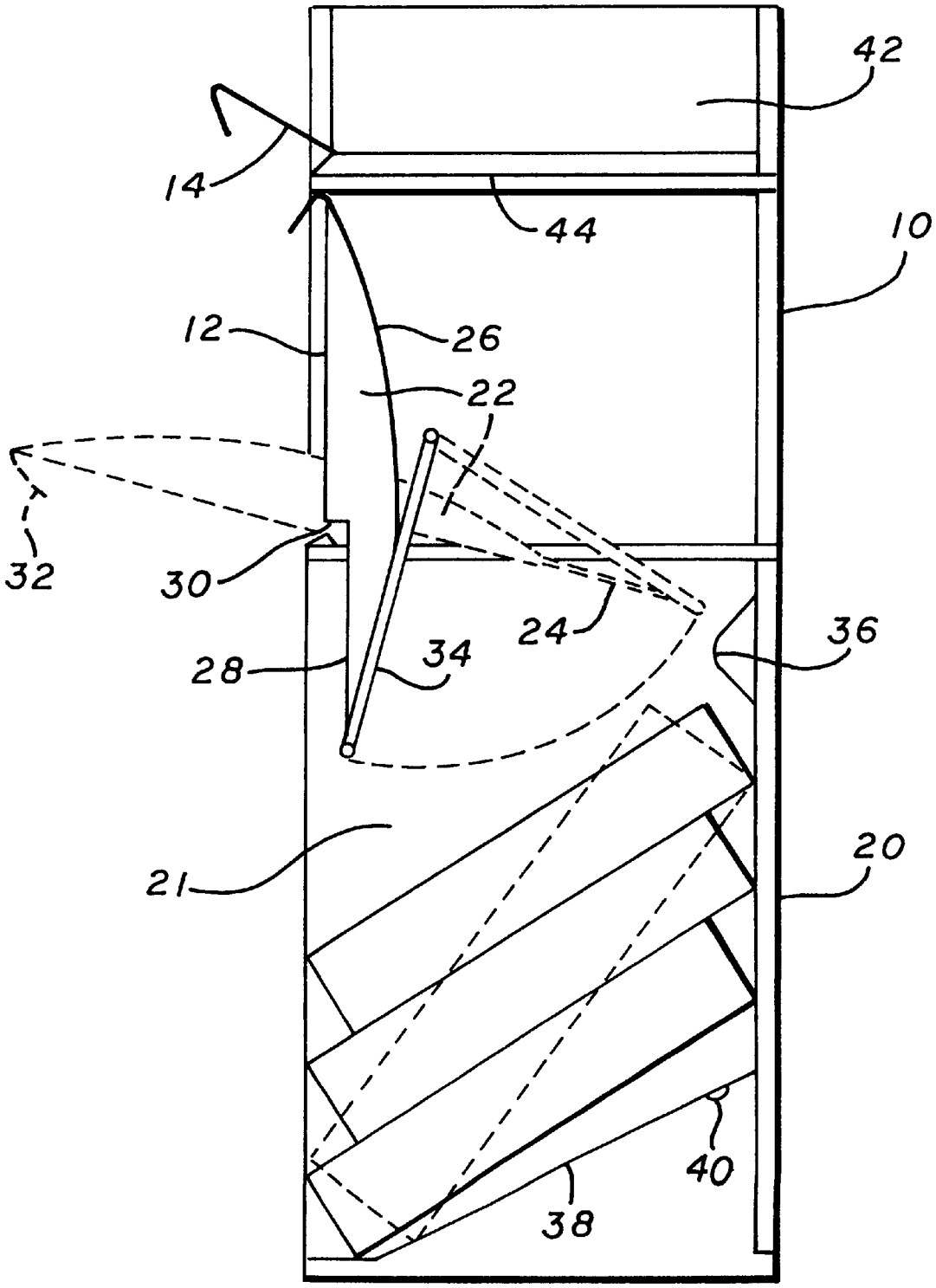
FIG. 2 is a cross sectional view of a delivery receptacle similar to that shown in FIG. 1.

FIG. 2 is a cross-sectional view of receptacle 10. In this view, it will be noted that loading doors 12 and 14 are located on the same side of the receptacle. The receptacle is preferably constructed entirely of steel. For maximum durability, stainless steel is preferred, although other steel alloys may be used with suitable corrosion protection. Other durable materials may also be used. As noted above, the exterior surfaces of receptacle 10 may be covered with a decorative material, which may also be selected to enhance the durability of the receptacle.

The majority of the interior volume of receptacle 10 is devoted to a first compartment 21 for receiving small packages and the like. Packages deposited in compartment 21 may be retrieved through door 20 on the back side of the receptacle. As mentioned above, access to compartment 21 for deliveries is provided through loading door 12. Door 12 has a main section 22 and a secondary section 24 that telescopes within the main section. The main section 22 comprises an upper portion 26, which is the only portion of door 22 that is visible from the exterior of the receptacle, and a lower portion 28. Door 12 pivots on a hinge 30 at the bottom of upper portion 26. A handle 32 is provided at the top of upper portion 26 for operating the loading door. A linkage member 34 is pivotally coupled at a first end to the secondary section 24 of the loading door. The opposite end of linkage member 34 is pivotally coupled to the interior wall of the receptacle. Although only one linkage member is shown in FIG. 2, identical linkage members are preferably provided on each side of the loading door.

As loading door 12 is opened to the position shown in phantom lines, secondary section 24 is extended outwardly by operation of linkage member 34. This provides a receiving shelf for delivery of a package and, more importantly, prevents an individual from reaching into compartment 21 when the loading door is open. The weight of the upper portion 26 is counterbalanced by the combined weight of secondary section 24 and lower portion 28 so that loading door 12 is biased toward the closed position. A bumper 36 is positioned opposite loading door 12 to help guide packages, particularly large packages, into compartment 21.

When a package is deposited, it slides toward the back of the receptacle until a corner of it is in contact with bumper 36. As loading door 12 returns to the closed position, the package rotates about the corner resting on bumper 36 so that successively delivered packages are stacked as indicated in the drawing.

The floor of compartment 21 is defined by deck plate 38, which is slightly inclined towards the front of the receptacle. This angle helps to stack successively delivered packages and also facilitates drainage in the event that liquid leaks from a delivered package. Deck plate 38 is preferably hinged at the front of the receptacle to provide access for mounting the receptacle structure to a suitable foundation. A pressure sensor 40 or similar means may be provided to indicate when a package has been delivered into the receptacle. Sensor 40 may activate a light or other signal means on the receptacle itself or may communicate with a remote indicator. Sensor 40 may be electrically coupled to circuitry that will automatically record the time and date of delivery.

A second compartment 42 is optionally provided for receiving letters and other mail. Access to compartment 42 is provided through loading door 14. Compartment 42 is separated from compartment 21 by partition 44. Partition 44 may be perforated or fabricated of a screen material so that the interior of compartment 21 may be viewed through loading door 14. This is especially useful for determining if a package has been delivered into the receptacle if an indicator is not otherwise provided.

The dimensions of receptacle 10 may be selected as a matter of convenience. Different sizes of receptacles may be offered, which may be selected based upon the space available at the installation site. In one embodiment, receptacle 10 has a width of approximately 20 inches, a depth of approximately 18 inches, and an overall height of approximately 47.5 inches. The opening for door 12 is approximately 19 inches wide by 12 inches high. In an embodiment where door 14 is located on the same side of receptacle 10 as door 12, the opening for door 14 is approximately 19 inches wide by 5 inches high.

Figure 4:
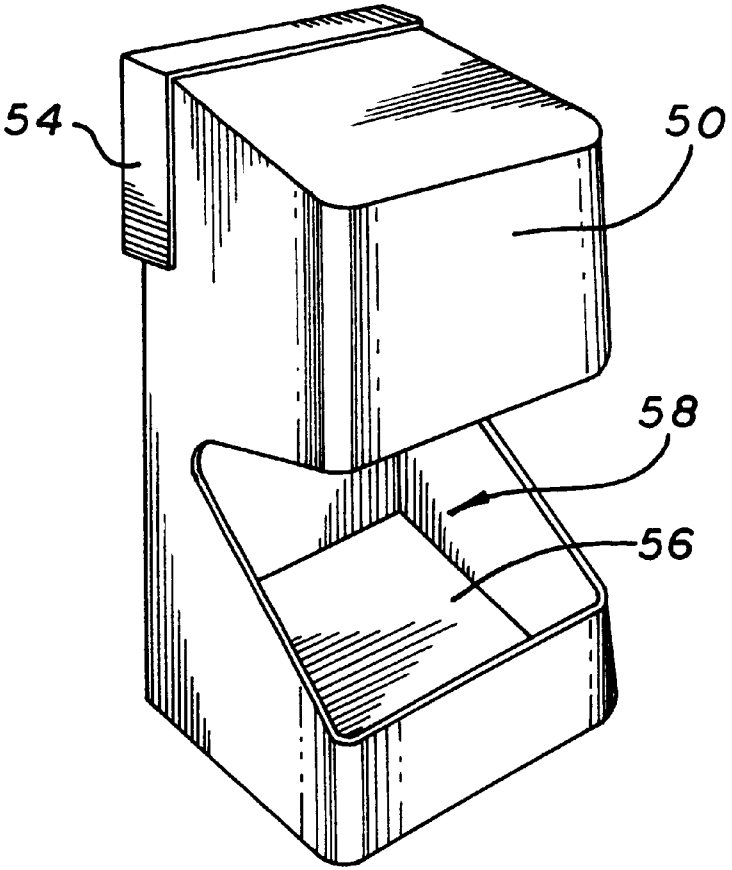
FIG. 4 is a perspective view of the delivery receptacle shown in FIG. 3.
Figure 3:
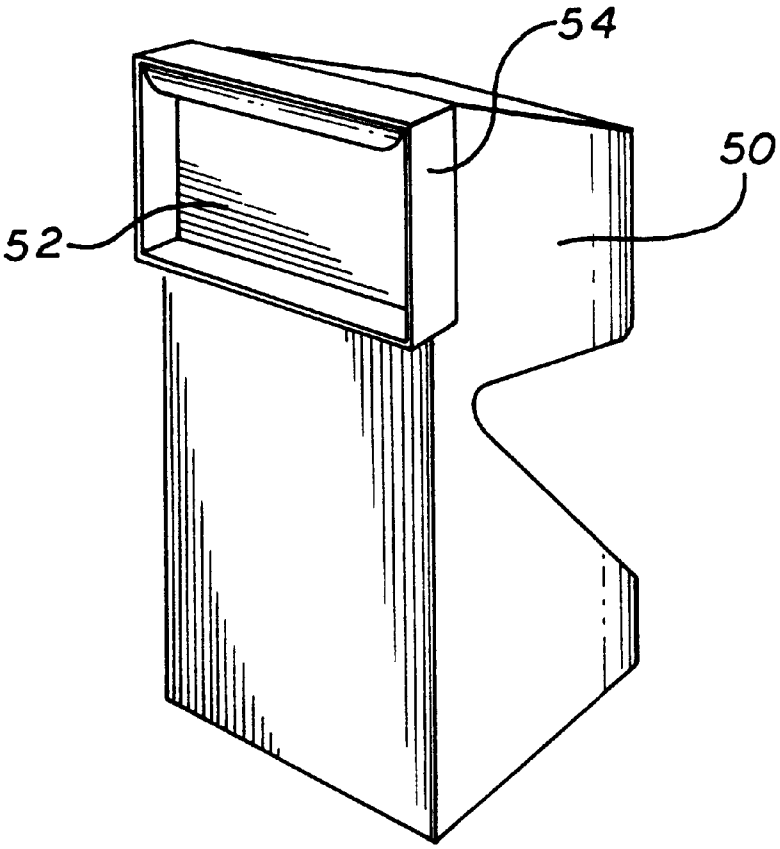
FIG. 3 is a first perspective view of an alternate embodiment of the present invention.

FIGS. 3 and 4 illustrates an alternative embodiment of the invention designed for mounting in a wall of a building or other structure. Receptacle 50 has a loading door 52 that is substantially identical to loading door 12. A weather shroud 54 surrounds loading door 52, which are the only portions of receptacle 50 that would normally be visible when suitably mounted in a wall of a structure. Door 52 preferably includes a magnetic or friction catch to more securely retain it in a closed position so that household pets cannot escape through receptacle 50. As best seen in FIG. 4, the rear of receptacle 50 is open to facilitate removal of delivered packages. In this embodiment, deck 56 of receptacle 50 is inclined toward the rear of the receptacle. If the quantity of delivered packages exceeds the capacity of bin 58, additional packages will simply slide out of the bin and onto the floor of the structure.

With reference again to FIG. 1, indicia 60 are preferably provided on or adjacent to the receptacle loading door 12. Indicia 60 are preferably in the form of a bar code on a stainless steel plaque or other suitable durable material. Indicia 60 uniquely identify the delivery location of the receptacle and are machine readable by an optical scanner or equivalent means. Indicia 60 serve as an electronic "signature" of the intended recipient. When a delivery is made, the delivery person scans indicia 60 with a hand held device, which then maintains an electronic record of the delivery location.

Indicia 60 may be advantageously used to provide remote notification that a delivery has occurred. It is common practice for delivery services to scan packages as they are delivered and to transmit delivery information to a central station. By also scanning indicia 60, the central station records can easily include identification of the delivery location. If the recipient has made suitable arrangements with the delivery service, the central station can then transmit a notification that delivery has been accomplished. Such notification may be made, for example, by transmitting a message to the recipient's paging receiver.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A method for notifying a delivery recipient that a delivery to a location has been accomplished comprising the steps of:

providing a delivery receptacle at the location having machine-readable indicia thereon; scanning the machine-readable indicia at the time of delivery to the receptacle;

transmitting data corresponding to the machine-readable indicia to a central station; transmitting a notification to the delivery recipient from the central station.

2. The method of claim 1 wherein the machine-readable indicia comprise a bar code.

3. The method of claim 1 wherein the step of transmitting a notification to the delivery recipient comprises activation of a paging receiver.

* * * * *

UNITED STATES PATENT AND TRADEMARK OFFICE

CERTIFICATE OF CORRECTION

PATENT NO. : 6,138,910
DATED : October 31, 2000
INVENTOR(S) : Madruga

It is certified that error appears in the above-identified patent and that said Letters Patent is hereby corrected as shown below:

Title page,
Item [73] Assignee, delete "Highland Ranch" and insert -- Highlands Ranch --

Drawings,
Column 1,
Line 59, after "FIG. 4 is a" insert -- second --

Signed and Sealed this

Sixth Day of November, 2001

*Attest:*

Nicholas P. Godici

NICHOLAS P. GODICI
*Acting Director of the United States Patent and Trademark Office*

*Attesting Officer*